US005840662A

United States Patent [19]

Nibert et al.

[11] Patent Number: 5,840,662

[45] Date of Patent: Nov. 24, 1998

[54] LUBRICATING OILS OF IMPROVED FRICTION DURABILITY

[75] Inventors: Roger Keith Nibert, Hampton; Raymond Frederick Watts, Long Valley; Ricardo Alfredo Bloch, Scotch Plains, all of N.J.

[73] Assignee: Exxon Chemical Patents Inc., Linden, N.J.

[21] Appl. No.: 919,961

[22] Filed: Aug. 28, 1997

Related U.S. Application Data

[63] Continuation of Ser. No. 544,953, Oct. 18, 1995, abandoned.

[51] Int. Cl.[6] ..... C10M 133/16

[52] U.S. Cl. ..... 508/291; 508/306; 508/492; 508/501; 508/555; 252/77

[58] Field of Search ..... 508/291

[56] References Cited

U.S. PATENT DOCUMENTS

| | | | |
|---|---|---|---|
| 3,216,936 | 11/1965 | LeSuer | 252/32.7 |
| 3,234,131 | 2/1966 | Morway | 252/56 D |
| 3,382,172 | 5/1968 | Lowe | 252/42.7 |
| 3,412,111 | 11/1968 | Irwin et al. | 252/396 |
| 3,544,467 | 12/1970 | Knutsky | 252/51.5 |
| 3,843,542 | 10/1974 | Adams | 252/56 D |
| 3,879,306 | 4/1975 | Kablaoui et al. | 252/51.5 A |
| 3,955,940 | 5/1976 | Hollyday, Jr. | 44/62 |
| 4,225,447 | 9/1980 | Law et al. | 252/56 D |
| 4,325,827 | 4/1982 | Papay et al. | 252/51.5 A |
| 4,613,341 | 9/1986 | Zaweski et al. | 44/57 |
| 4,659,492 | 4/1987 | Jahnke | 252/49.3 |
| 4,702,850 | 10/1987 | Gutierrez et al. | 252/56 D |
| 4,780,111 | 10/1988 | Dorer et al. | 44/71 |
| 4,997,594 | 3/1991 | Walsh | 252/51.5 A |
| 5,122,616 | 6/1992 | Malfer | 548/546 |
| 5,156,654 | 10/1992 | Koch et al. | 44/331 |
| 5,176,840 | 1/1993 | Campbell et al. | 252/49.6 |
| 5,225,093 | 7/1993 | Campbell et al. | 252/51.005 A |
| 5,516,444 | 5/1996 | Gaines et al. | 252/51.5 A |

FOREIGN PATENT DOCUMENTS

| | | | |
|---|---|---|---|
| 0020037-A1 | 12/1980 | European Pat. Off. | C10M 1/36 |
| 0074199 | 3/1983 | European Pat. Off. | C10M 1/32 |
| 0305538 | 3/1989 | European Pat. Off. | C10M 141/02 |
| 0393769 | 10/1990 | European Pat. Off. | C10M 133/16 |
| 0608041 | 7/1994 | European Pat. Off. | C07D 207/404 |
| 0678569 | 12/1995 | European Pat. Off. | C10M 141/12 |
| WO83/03616 | 10/1983 | WIPO | C10L 1/22 |
| WO90/04625 | 5/1990 | WIPO | C10M 133/16 |

*Primary Examiner*—Ellen M. McAvoy

[57] ABSTRACT

The frictional durability of lubricating oils, including power transmitting fluids and in particular automatic transmission fluids, are improved by incorporating a combination of low potency friction modifiers, ashless and/or metal-containing antioxidants, and oil-soluble phosphorus-containing compounds.

10 Claims, No Drawings

LUBRICATING OILS OF IMPROVED FRICTION DURABILITY

This is a continuation of application Ser. No. 08/544,953 filed on Oct. 18, 1995 now abandoned.

BACKGROUND OF THE INVENTION

This invention relates to a composition and a method of improving the friction durability of lubricating oils, particularly power transmitting fluids such as automatic transmission fluids (ATF's), and more particularly to the frictional characteristics exhibited by the ATF during high speed clutch engagements of an automatic transmission.

A common goal of automobile builders is to produce vehicles that are more durable and perform more reliably over their service life. One aspect of increased durability and reliability is to produce vehicles that need a minimum of repairs during their service life. A second aspect is to have vehicles that perform consistently throughout this "lifetime". In the case of automatic transmissions, not only should the transmission not fail during the lifetime of the vehicle, but its shift characteristics should not perceptively change over this period. Since shift characteristics of automatic transmissions are primarily dependent on the frictional characteristics of the ATF, the fluid needs to have very stable frictional performance with time, and therefore mileage. This aspect of ATF performance is known as friction durability. Currently many vehicle builders are moving to "fill-for-life" automatic transmission fluids, this trend further increases the need for friction stability of the ATF, since the fluid will no longer be replaced at 15,000 to 50,000 mile intervals.

A common method for determining the friction durability of an ATF is through the use of an SAE #2 friction test machine. This machine simulates the high speed engagement of a clutch by using the clutch as a brake, thereby absorbing a specified amount of energy. The energy of the system is chosen to be equivalent to the energy absorbed by the clutch in completing one shift in the actual vehicle application. The machine uses a specified engagement speed, normally 3600 rpm, and a calculated inertia to provide the required amount of energy to the test clutch and fluid. The clutch is lubricated by the fluid being evaluated, and each deceleration (i.e., braking) of the system is termed one cycle. To evaluate friction durability many cycles are run consecutively. Increasing emphasis on friction durability by original equipment manufacturers (OEM's) has caused the total number of cycles required to demonstrate satisfactory friction durability to increase from several hundred in the 1980's to more than 30,000 in some proposed specifications.

There are two methods of assessing improved friction durability. One is to maintain certain friction characteristics over a longer period of time (cycles). The second is to allow less change in each friction parameter over the same number of cycles. Both methods provide indications that the vehicle shift characteristics will be consistent over a longer number of miles.

Conventionally, there are two ways to improve friction durability. One way is to increase the amount of friction modifier in the fluid. This has the desired effect of improving friction durability, but increasing the amount of friction modifier has the undesirable effect of lowering the friction coefficients of the fluid to undesirable levels, especially the static coefficient of friction. The second method is to improve the oxidation resistance of the fluid because the polar products of oxidation compete with the friction modifiers for the friction surface. Reducing fluid oxidation makes long term control of friction difficult.

What we have now found is that a combination of antioxidants, oil soluble phosphorus compounds, and specific low potency friction modifiers can confer outstanding friction durability to ATF's. These low potency friction modifiers are characterized by the fact that once a saturation concentration of the friction modifier is reached in the fluid, increasing the concentration causes no further reduction in the measured friction levels. Fluids can be treated with very high concentrations of these low potency friction modifiers and still exhibit satisfactory levels of friction. It is believed that as the low potency friction modifier molecules are consumed, through shearing or oxidation, there is always an ample concentration available to take their place. The antioxidant is also a critical aspect of the invention, since for the low potency friction modifiers to work, the formation of highly polar products of oxidation must be minimized. An oil-soluble phosphorus-containing compound must also be present to protect the system from wear.

SUMMARY OF THE INVENTION

This invention relates to lubricating oil compositions and a method for improving the friction durability of lubricating oils comprising:

(1) a major amount of a lubricating oil; and (2) a friction durability improving effective amount of an additive combination comprising:

(a) an antioxidant;

(b) a low potency friction modifier selected from the group consisting of structures (I), (II) and (III), and their mixtures, where (I), (II), and (III) are represented by:

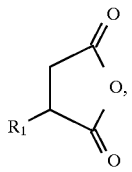

(I)

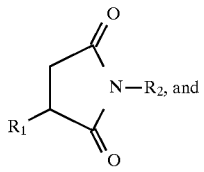

(II)

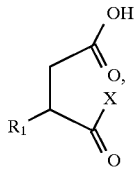

(III)

where:

$R_1$ is a $C_6$ to $C_{30}$ isomerized alkenyl group, represented by:

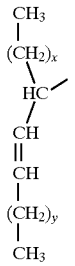

where x and y are integers whose sum is from 1 to 25, or its fully saturated alkyl analog, $R_2$ is an alkyl group, aryl group, and their heteroatom containing derivatives, X is represented by

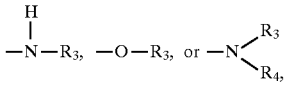

$R_3$ and $R_4$ are independently alkyl, aryl, and their heteroatom containing derivatives; and (c) an oil-soluble phosphorus-containing compound.

DETAILED DESCRIPTION OF THE INVENTION

This invention describes a method for improving the friction durability of lubricating oils, without unnecessarily lowering the coefficients of friction. It is comprised of a low potency friction modifier having an isomerized alkenyl group or its fully saturated alkyl analog, an antioxidant, and an oil-soluble source of phosphorus. This combination of additives uniquely provide outstanding friction durability to ATF's.

While the benefits of this invention are contemplated to be applicable to a wide variety of lubricating oils (e.g., crankcase engine oils, etc.), particularly benefited compositions are power transmitting fluids, especially automatic transmission fluids. Examples of other types of power transmitting fluids included within the scope of this invention are gear oils, hydraulic fluids, heavy duty hydraulic fluids, industrial oil, power steering fluids, pump oils, tractor fluids, universal tractor fluids and the like. These power transmitting fluids can be formulated with a variety of performance additives and in a variety of base oils.

Low Potency Friction Modifiers

The friction modifiers of the present invention are those produced from succinic anhydrides substituted with isomerized alkenyl groups or their fully saturated alkyl analogs. Preparation of the isomerized alkenyl succinic anhydrides is well known and is described in, for example, U.S. Pat. No. 3,382,172. Commonly these materials are prepared by heating alpha-olefins with acidic catalysts to migrate the double bond to an internal position. This mixture of olefins (2-enes, 3-enes, etc.) is then thermally reacted with maleic anhydride. Typically olefins from $C_6$ (1-hexene) to $C_{30}$ (1-tricosane) are used. Suitable isomerized alkenyl succinic anhydrides of structure (I) include iso-decylsuccinic anhydride (x+y=5), iso-dodecylsuccinic anhydride (x+y=7), iso-tetradecylsuccinic anhydride (x+y=9), iso-hexadecylsuccinic anhydride (x+y=11), iso-octadecylsuccinic anhydride (x+y=13) and iso-eicosylsuccinic anhydride (x+y=15). Preferred materials are iso-hexadecylsuccinic anhydride and iso-octadecylsuccinic anhydride.

The materials produced by this process contain one double bond (alkenyl group) in the alkyl chain. The alkenyl substituted succinic anhydrides may be easily converted to their saturated alkyl analogs by hydrogenation.

The isomerized-alkenyl or saturated-alkyl succinic anhydrides can be reacted with primary amines, secondary amines, or alcohols to produce friction modifiers of the types shown in structures (II) and (III).

Suitable primary and secondary amines useful to produce the friction modifiers of structures (II) and (III) are represented by structure (IV):

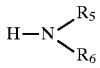

(IV)

where:

$R_5$ and $R_6$ are independently alkyl, aryl, their heteroatom containing derivatives, or H with the proviso that $R_5$ and $R_6$ are not both H.

Preferred amines are n-hexylamine, di-n-hexylamine, dimethylamine, n-butylamine, diethanol amine and di-methylaminopropylamine.

A particularly useful class of amines are the polyamines. Suitable polyamines are saturated amines of the general formula (V), where (V) is:

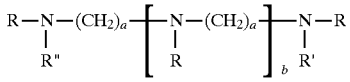

(V)

where R, R', and R" are independently selected from the group consisting of hydrogen; $C_1$ to $C_{25}$ straight or branched chain alkyl radicals; $C_1$ to $C_{12}$ alkoxy radicals; $C_2$ to $C_6$ alkylene radicals; a is an integer from 1 to 6, preferably 2 to 4; and b is an integer from 0 to 10, preferably from 1 to 4. Non-limiting examples of suitable polyamine compounds include: 1,6-diaminohexane, diethylene triamine, triethylene tetramine, tetraethylene pentamine and pentaethylene hexamine. Low cost mixtures of polyamines having from 5 to 7 nitrogen atoms per molecule are available from Dow Chemical Co. as Polyamine H, Polyamine 400 and Polyamine E-300.

Polyoxyalkylene amines are also useful in this invention and are shown as structure (VI), where (VI) is:

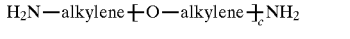

(VI)

where c is an integer of from 1 to 10. The polyamines have molecular weights from about 100 to 500. The preferred polyoxyalkylene polyamines include polyoxyethylene and polyoxypropylene diamines and the polyoxypropylene triamines. Commercial polyoxyalkylene amines are available from Jefferson Chemical Co. sold under the trade name "Jeffamines D-230, D-400, D-1000, T-430," etc.

The alcohols useful with the present invention are the alkylene diols. The diols of this invention can be represented by structure (VII):

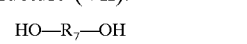

(VII)

where $R_7$ is a $C_1$ to $C_{12}$ alkyl radical, a $C_1$ to $C_{12}$ alkylene radical, or $C_6$ to $C_{20}$ aryl radical. $R_7$ may be straight or branched, it may contain hetero atoms (N, S, or O) and it also may contain aromatic substituents. Preferred diols of the present invention are: 1,4-butanediol, 1,5-hexanediol, thiodiglycol, dithiodiglycol, diethanolamine, and 1,2-propanediol.

The friction modifiers of this invention are normally prepared by heating the isomerized alkenyl succinic anhydride (or its saturated-alkyl analog) with the amine or alcohol and removing the water formed. However, other methods of preparation are known and can be used. The ratio of amine or alcohol to succinic anhydride grouping is usually 1 to 1. In the case of diamines or polyamines where the molecule is terminated on both ends with an amine, or similarly a polyol with two (2) —OH groups, it may be desirable to react both ends of the molecule (amines or alcohols) with the alkylsuccinic anhydride giving materials of structures (VIII) and (IX), where (VIII) and (IX) are:

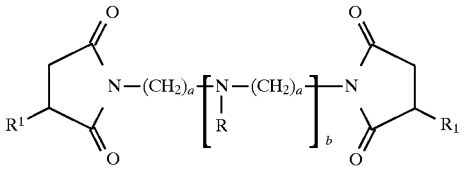

(VIII)

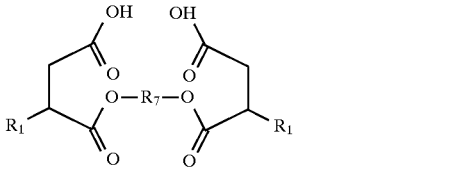

(IX)

where R, $R_1$, $R_7$, a, and b are as previously defined.

In the case of products of isomerized-alkenyl or saturated alkyl succinic anhydrides and polyamines (i.e., structure (VIII)) the products may be further post reacted with boron, phosphorus, and/or maleic anhydride by any of the many known post-treating processes (see e.g., U.S. Pat. Nos. 3,254,025; 3,502,677; 4,686,054; and 4,857,214).

The preferred friction modifiers of this invention are those produced by reacting the isomerized-alkenyl succinic anhydrides with amines (IV), polyamines (V), or polyoxyalkylene amines (VI). The most preferred products of this invention are those produced from reaction of the isomerized-alkenyl succinic anhydrides with polyamines.

Treat rates of the friction modifiers of the present invention are from about 0.1 to about 10, preferably 0.5 to 7, and most preferably from 1.0 to 5.0 weight percent in the lubricating composition.

Examples of preparation of typical friction modifier materials of the invention are given below. These examples are intended for illustration and the invention is not limited to the specific details set forth in the examples.

PREPARATIVE EXAMPLES

Example A

Into a one liter round bottomed flask fitted with a mechanical stirrer, nitrogen sweep, Dean Starke trap and condenser was placed 352 gm (1.00 mole) of iso-octadecenylsuccinic anhydride (ODSA from Dixie Chemical Co.). A slow nitrogen sweep was begun, the stirrer started and the material heated to 130° C. Immediately thereafter, 87 gm (0.46 moles) of commercial tetraethylene pentamine was added slowly through a dip tube to the hot stirred iso-octadecenylsuccinic anhydride. The temperature of the mixture increased to 150° C. where it was held for two hours. During this heating period 8 ml. of water (~50% of theoretical yield) were collected in the Dean Starke trap. The flask was cooled to yield the product. Yield: 427 gm. Percent nitrogen: 7.2.

Example B

The same procedure was followed as in Example A, except that the following amounts were used: iso-octadecenylsuccinic anhydride, 458 gm (1.3 moles), and diethylenetriamine, 61.5 gm (0.6 mole). The water recovered was 11 ml. Yield: 505 gm. Percent nitrogen: 4.97.

Example C

The same procedure was followed as in Example A, except that the following amounts were used: iso-hexadecenylsuccinic anhydride (ASA-100 from Dixie Chemical Co.), 324 gm (1.0 mole); and tetraethylenepentamine, 87 gm, 0.46 mole). The water recovered was 9 ml. Yield: 398 gm. Percent nitrogen: 8.1.

Example D

The same procedure was followed as in Example A, except that the following amounts were used: iso-octadecenylsuccinic anhydride, 352 gm (1.0 mole), and: dimethylaminopropyl amine, 102 gm (1.0 mole). The water recovered was 15 ml. Yield: 429 gm. Percent nitrogen: 6.4.

Example E

The same procedure was followed in Example A, except that to the hot iso-octadecenylsuccinic anhydride, 352 gm (1.0 mole) was added dropwise, thiobisethanol 61 gm (0.5 mole). The water recovered was 14 ml. Yield: 392 gm. Percent sulfur: 4.0.

Antioxidants

The antioxidants of the present invention are of two types, (1) the ashless antioxidants such as arylamines and phenols, and (2) the metal-containing antioxidants such as zinc dialkyldithiophosphates.

The ashless antioxidants useful with this invention are either aryl amines or phenols. The amine type antioxidants include phenyl-alpha-naphthylamine, diphenylamine, phenothiazine, p-phenylene diamine, alkylated diphenylamines (e.g., p,p'-bis(alkylphenyl) amines wherein the alkyl groups contain from 8 to 12 carbons atoms each; such a material is Naugalube® 438L). Phenolic antioxidants include sterically hindered phenols (e.g., 2,6-di-t-butyl phenol, 4-methyl-2,6-di-t-butyl-phenol) and bis-phenols (4,4'-methylenebis(2,6-di-t-butylphenol); such a material is Ethyl® 702). Another class of phenolic antioxidants are the 4-substituted 2,6-di-t-butyl phenols, these would include materials such as 3,5-di-t-butyl-4-hydroxyhydrocinnamic acid, $C_7$–$C_9$ ester. (Such a material is Irganox® L-135).

The metal-containing antioxidants useful with this invention are the zinc dithiodiphosphates (ZDDP). These antioxidants are produced by reaction of alcohols with $P_2S_5$ to produce dialkylthiophosphoric acids, which are then treated/reacted with zinc oxide. The preparation of zinc dithiodiphosphate is well known and discussed in much published literature. See for example the books, "Lubricant Additives," by C. V. Smalheer and R. K. Smith, published by Lezius-Hiles Co., Cleveland, Ohio (1967) and "Lubricant Additives," by M. W. Ranney, published by Noyes Data Corp., Park Ridge, N.J. (1973). Examples of such materials are zinc (di-isooctyldithiophosphoric acid) and zinc (di-2-ethylhexyldithiophosphoric acid).

The lubricating oil compositions of this invention would contain one or more of the above antioxidants singly or in any combination. The total concentration of antioxidant would typically be from 0.1 to 5, preferably from 0.2 to 3.0, and most preferably from 0.25 to 2.0 weight percent in the finished fluid.

In the case when the lubricating oil composition is an ATF containing a ZDDP antioxidant and the friction modifier of structure (VIII), the ZDDP antioxidant concentration should not be more than 1.0 mass percent in the finished ATF.

Oil-Soluble Phosphorus-Containing Compounds

The oil-soluble phosphorus-containing compounds useful in this invention may vary widely and are not limited by chemical type. The only limitation is that the material be oil soluble. Examples of suitable phosphorus compounds are: phosphites and thiophosphites (mono-alkyl, di-alkyl, tri-alkyl and partially hydrolyzed analogs thereof); phosphates and thiophosphates; amines treated with inorganic phosphorus such as phosphorous acid, phosphoric acid or their thio analogs; zinc dithiodiphosphates; amine phosphates. Examples of particularly suitable phosphorus compounds include: mono-n-butyl-hydrogen-acid-phosphite; di-n-butyl-hydrogen phosphite; triphenyl phosphite; triphenyl thiophosphite; tri-n-butylphosphate; 900MW polyisobutenyl succinic anhydride (PIBSA) polyamine dispersant post treated with $H_3PO_3$ and $H_3BO_3$ (see e.g., U.S. Pat. No. 4,857,214); zinc (di-2-ethylhexyldithiophosphate).

It will be appreciated by those skilled in the art that the metal-containing antioxidants (e.g., zinc dithiodiphosphates), may function, both as an antioxidant and an oil-soluble phosphorus source as described in the present invention.

Other additives known in the art may be added to the lubricating oil. These additives include dispersants, antiwear agents, corrosion inhibitors, detergents, extreme pressure additives, and the like. They are typically disclosed in, for example, "Lubricant Additives" by C. V. Smalheer and R. Kennedy Smith, 1967, pp. 1–11 and U.S. Pat. No. 4,105,571.

Representative amounts of these additives in an ATF are summarized as follows:

| Additive | (Broad) Wt. % | (Preferred) Wt. % |
|---|---|---|
| VI Improvers | 1–12 | 1–4 |
| Corrosion Inhibitor | 0.01–3 | 0.02–1 |
| Dispersants | 0.10–10 | 2–5 |
| Antifoaming Agents | 0.001–5 | 0.001–0.5 |
| Detergents | 0.01–6 | 0.01–3 |
| Antiwear Agents | 0.001–5 | 0.2–3 |
| Pour Point Depressants | 0.01–2 | 0.01–1.5 |
| Seal Swellants | 0.1–8 | 0.5–5 |
| Lubricating Oil | Balance | Balance |

Suitable dispersants include hydrocarbyl succinimides, hydrocarbyl succinamides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Mixtures of such dispersants can also be used.

The preferred dispersants are the alkenyl succinimides. These include acyclic hydrocarbyl substituted succinimides formed with various amines or amine derivatives such as are widely disclosed in the patent literature. Use of alkenyl succinimides which have been treated with an inorganic acid of phosphorus (or an anhydride thereof) and a boronating agent are also suitable for use in the compositions of this invention as they are much more compatible with elastomeric seals made from such substances as fluoro-elastomers and silicon-containing elastomers. Polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight in the range of 500 to 5000 (preferably 800 to 2500) are particularly suitable. Dispersants may be post-treated with many reagents known to those skilled in the art. (see, e.g., U.S. Pat. Nos. 3,254,025, 3,502,677 and 4,857,214).

The additive combinations of this invention may be combined with other desired lubricating oil additives to form a concentrate. Typically the active ingredient (a.i.) level of the concentrate will range from 20 to 90%, preferably from 25 to 80%, most preferably from 35 to 75 weight percent of the concentrate. The balance of the concentrate is a diluent typically comprised of a lubricating oil or solvent.

Lubricating oils useful in this invention are derived from natural lubricating oils, synthetic lubricating oils, and mixtures thereof. In general, both the natural and synthetic lubricating oil will each have a kinematic viscosity ranging from about 1 to about 100 $mm^2/s$ (cSt) at 100° C., although typical applications will require each oil to have a viscosity ranging from about 2 to about 8 $mm^2/s$ (cSt) at 100° C.

Natural lubricating oils include animal oils, vegetable oils (e.g., castor oil and lard oil), petroleum oils, mineral oils, and oils derived from coal or shale. The preferred natural lubricating oil is mineral oil.

Suitable mineral oils include all common mineral oil basestocks. This includes oils that are naphthenic or paraffinic in chemical structure. Oils that are refined by conventional methodology using acid, alkali, and clay or other agents such as aluminum chloride, or they may be extracted oils produced, for example, by solvent extraction with solvents such as phenol, sulfur dioxide, furfural, dichlordiethyl ether, etc. They may be hydrotreated or hydrofined, dewaxed by chilling or catalytic dewaxing processes, or hydrocracked. The mineral oil may be produced from natural crude sources or be composed of isomerized wax materials or residues of other refining processes.

Typically the mineral oils will have kinematic viscosities of from 2.0 $mm^2/s$ (cSt) to 8.0 $mm^2/s$ (cSt) at 100° C. The preferred mineral oils have kinematic viscosities of from 2 to 6 $mm^2/s$ (cSt), and most preferred are those mineral oils with viscosities of 3 to 5 $mm^2/s$ (cSt) at 100° C.

Synthetic lubricating oils include hydrocarbon oils and halo-substituted hydrocarbon oils such as oligomerized, polymerized, and interpolymerized olefins [e.g., polybutylenes, polypropylenes, propylene, isobutylene copolymers, chlorinated polylactenes, poly(1-hexenes), poly (1-octenes), poly-(1-decenes), etc., and mixtures thereof]; alkylbenzenes [e.g., dodecyl-benzenes, tetradecylbenzenes, dinonyl-benzenes, di(2-ethylhexyl)benzene, etc.]; polyphenyls [e.g., biphenyls, terphenyls, alkylated polyphenyls, etc.]; and alkylated diphenyl ethers, alkylated diphenyl sulfides, as well as their derivatives, analogs, and homologs thereof, and the like. The preferred oils from this class of synthetic oils are oligomers of α-olefins, particularly oligomers of 1-decene.

Synthetic lubricating oils also include alkylene oxide polymers, interpolymers, copolymers, and derivatives thereof where the terminal hydroxyl groups have been modified by esterification, etherification, etc. This class of synthetic oils is exemplified by: polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polypropylene glycol having a molecular weight of 1000 –1500); and mono- and poly-carboxylic esters thereof (e.g., the acetic acid esters, mixed $C_3$–$C_8$ fatty acid esters, and $C_{12}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebasic acid with two moles of tetraethylene glycol and two moles of 2-ethyl-hexanoic acid, and the like. A preferred type of oil from this class of synthetic oils are adipates of $C_4$ to $C_{12}$ alcohols.

Esters useful as synthetic lubricating oils also include those made from $C_5$ to $C_{12}$ monocarboxylic acids and polyols and polyol ethers such as neopentyl glycol, trimethylolpropane pentaerythritol, dipentaerythritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetra-ethyl silicate, tetraisopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy)-disiloxane, poly(methyl)-siloxanes and poly (methylphenyl) siloxanes, and the like. Other synthetic lubricating oils include liquid esters of phosphorus-containing acids (e.g., tricresyl phosphate, trioctyl phosphate, and diethyl ester of decylphosphonic acid), polymeric tetra-hydrofurans, poly-α-olefins, and the like.

The lubricating oils may be derived from refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and are often additionally processed by techniques for removal of spent additives and oil breakdown products.

When the lubricating oil is a mixture of natural and synthetic lubricating oils (i.e., partially synthetic), the choice of the partial synthetic oil components may widely vary, however, particularly useful combinations are comprised of mineral oils and poly-α-olefins (PAO), particularly oligomers of 1-decene.

The following examples are given as specific illustrations of the claimed invention. It should be understood, however, that the invention is not limited to the specific details set forth in the examples. All parts and percentages are by weight unless otherwise specified.

EXAMPLES

The Ford MERCON® 15,000 cycle friction test (MERCON® Automatic Transmission Fluid Specification for Service, dated Sep. 1, 1992. Section 3.8) was chosen to demonstrate the friction durability of this invention's fluids because of the test's long duration (i.e., 15,000 test cycles) and its tightly specified limits. The Ford test stresses friction durability by using a low volume of fluid, 305 ml's, and high test energy per cycle, 20,740 joules. Repeated dissipation of this much energy into this small volume of test fluid for 15,000 cycles is a strenuous evaluation of the fluid's ability to maintain constant frictional characteristics.

The variation allowed by Ford for each of the measured test parameters, from 100 to 15,000 cycles, is shown in Table 1. Also in Table 1 is a column entitled, '50% MERCON® Range'. As a measure of the ability of the compositions of this invention to provide exceedingly good friction durability, the blends that are representative of the current invention will be shown to possess less than half the friction variability, 100 to 15,000 cycles, that is allowed by Ford.

TABLE 1

FORD MERCON ® ALLOWABLE FRICTION RANGES (100 to 15,000 CYCLES)

| Pass/Fail Criteria | MERCON ® Allowed Range | 50% MERCON ® Range |
|---|---|---|
| Midpoint Dynamic Coefficient (Mu-D) | 0.030 | 0.015 |
| Low Speed Dynamic Peak (Mu-S1) | 0.040 | 0.020 |
| Static Breakaway Coefficient (Mu-S) | 0.050 | 0.025 |

Table 2 summarizes the ten (10) ATF blends prepared and tested for friction durability according to the Ford MERCON® friction test. The compositions of each of the blends and the three pass/fail criteria (Mu-D, Mu-S1, Mu-S) are also shown in Table 2. In the 'Test Results' section of Table 2, any entry which exceeds more than 50% of the allowable MERCON® range for that parameter is shown in boldface typed and shaded.

In Table 2, Blends 1 through 4 are "comparative examples", in that they met one or two of the three criteria of the present invention, but not all three. Blend 1, which contains no phosphorus, fails the Mu-dynamic (Mu-D) stability criteria of the invention. Blend 2, which does not contain a friction modifier of the present invention fails Mu static (Mu-S) stability criteria. Blend 3, which contains no antioxidant, fails the Mu-dynamic (Mu-D) and the low speed dynamic peak (Mu-S1) stability criteria. Blend 4, which contains a conventional ethoxylated friction modifier, i.e., a friction modifier not encompassed by the present invention, fails the Mu-static (Mu-S) criteria. Blends 5 through 10, which contain all of the necessary components of the present invention, pass the requirement of having less than half the variability allowed by Ford for all three pass/fail criteria.

The principles, preferred embodiments, and modes of operation of the present invention have been described in the foregoing specification. However, the invention which is intended to be protected herein is not to be construed as limited to the particular forms disclosed, since these are to be regarded as illustrative rather than restrictive. Variations and changes may be made by those skilled in the art without departing from the spirit of the invention.

TABLE 2

| TEST FORMULATIONS and TEST RESULTS | BLENDS | | | | | | | | | | |
|---|---|---|---|---|---|---|---|---|---|---|---|
| | 1 | 2 | 3 | 4 | 5 | 6 | 7 | 8 | 9 | 10 | |
| COMPONENT | | | | | | | | | | | |
| Borated PIBSA/PAM Dispersant | 3.00 | 3.00 | 3.00 | 3.00 | 3.00 | 3.00 | 3.00 | 3.00 | 3.00 | 3.00 | 50% |
| Alkylated Diphenyl Amine Anti-oxidant | 0.25 | 0.25 | — | 0.25 | — | — | 0.25 | 0.25 | 0.25 | 0.25 | of |
| Hindered Phenolic Anti-oxidant | — | — | — | — | — | 0.25 | — | — | — | — | MERCON |
| Triphenyl phosphite | — | — | 0.10 | 0.10 | — | 0.10 | 0.10 | — | 0.10 | 0.10 | Range |
| C4, C5 Zinc Dithiodiphosphate | — | — | — | — | 0.30 | — | — | — | — | — | |
| 450 MW PIBSA/PAM post treated with H3PO3 | — | — | — | — | — | — | — | 1.00 | — | — | |
| iso-Octadecenyl Succinic Anhydride | — | — | — | — | — | — | — | — | 2.50 | — | |
| Product of Example A | 2.50 | — | 2.50 | — | 2.50 | 2.50 | 2.50 | 2.50 | — | — | |
| Product of Example C | — | — | — | — | — | — | — | — | — | 2.50 | |
| Ethoxylated Amine (C16–C18) | — | 0.20 | — | 0.20 | — | — | — | — | — | — | |
| Polymethacrylate Viscosity Modifier | 4.00 | 4.00 | 4.00 | 4.00 | 4.00 | 4.00 | 4.00 | 4.00 | 4.00 | 4.00 | |
| Exxon FN 1391 Baseoil | 90.25 | 92.55 | 90.40 | 92.45 | 90.20 | 90.15 | 90.15 | 89.25 | 90.15 | 90.15 | |
| TEST RESULTS | | | | | | | | | | | |
| TOTAL Mu RANGE, 100 to 15,000 CYCLES | | | | | | | | | | | |
| Mu Dynamic (Mu-D) | 0.0211 | 0.0123 | 0.0199 | 0.0105 | 0.0116 | 0.0081 | 0.0112 | 0.0082 | 0.0087 | 0.0090 | 0.0150 |
| Mu O (Mu-S1) | 0.0060 | 0.0155 | 0.0258 | 0.0193 | 0.0050 | 0.0129 | 0.0142 | 0.0076 | 0.0010 | 0.0060 | 0.0200 |
| Mu Static (Mu-S) | 0.0090 | 0.0291 | 0.0182 | 0.0313 | 0.0050 | 0.0195 | 0.0104 | 0.0070 | 0.0057 | 0.0060 | 0.0250 |

What is claimed is:

1. A power transmission in combination with a fluid composition comprising:

(1) a major amount of lubricating oil, and (2) a friction durability improving effective amount of an additive combination, the additive combination comprising a mixture of:

(a) an antioxidant;

(b) a low potency friction modifier selected from the group consisting of structures (I), (II), and (III), and their mixtures, where structures (I), (II), and (III) are represented by:

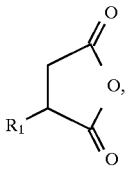

(I)

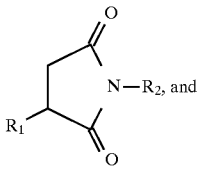

(II)

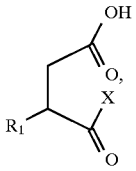

(III)

where: $R_1$ is a $C_6$ to $C_{30}$ isomerized alkenyl group represented by:

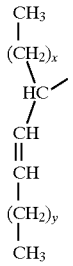

where x and y are integers whose sum is from 1 to 25, or its fully saturated analog, $R_2$ contains no less than 2 and no more than 100 carbon atoms and is an alkyl group, aryl group, or their heteroatom-containing derivatives, X is represented by

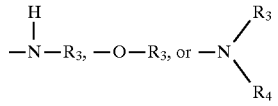

$R_3$ and $R_4$ are independently alkyl, aryl, or their heteroatom-containing derivatives; and (c) an oil-soluble phosphorus-containing compound.

2. The power transmission of claim 1, wherein the power transmission is an automatic transmission.

3. The automatic transmission of claim 2, where the lubricating oil is a mineral oil, poly-α-olefin, or mixtures thereof.

4. The automatic transmission of claim 3, where the antioxidant is an aryl amine, a phenol, a zinc salt of dialkylthiophosphoric acid, or mixtures thereof.

5. The automatic transmission of claim 2, where the oil-soluble phosphorus-containing compound is a phosphite, thiophosphite, phosphate, thiophosphate, amine phosphate, amines treated with inorganic phosphorus or their thio analogs, or mixtures thereof.

6. The automatic transmission of claim 2, where the sum of x and y is 13 or 15.

7. The automatic transmission of claim 2, where the composition is an automatic transmission fluid.

8. The automatic transmission of claim 2 where the friction modifier is selected from the group consisting of structures (VIII) and (IX), and their mixtures where structures (VIII) and (IX) are represented by:

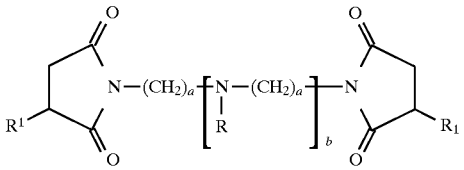

(VIII)

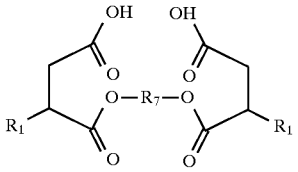

(IX)

where:

R is independently selected from the group consisting of hydrogen, $C_1$ to $C_{25}$ straight or branched chain alkyl radicals, $C_1$ to $C_{12}$ alkoxy radicals, and $C_2$ to $C_6$ alkylene radicals;

$R_1$ is as previously defined;

$R_7$ is selected from the group consisting of $C_1$ to $C_{12}$ alkyl or alkylene radicals, $C_6$ to $C_{20}$ aryl radicals, and their heteroatom-containing derivatives;

a is an integer from 1 to 6; and b is zero or an integer from 1 to 10.

9. The automatic transmission of claim 8 where R is alkenyl, x+y in $R_1$ is 13, a is 2, and b is 3.

10. A method of improving the performance of automatic transmission by incorporating into the automatic transmission a performance improving effective amount of a composition comprising:

(1) a major amount of lubricating oil, and (2) a friction durability improving effective amount of an additive combination, the additive combination comprising a mixture of:

(a) an antioxidant;

(b) a low potency friction modifier selected from the group consisting of structures (I), (II), and (III), and their mixtures, where structures (I), (II), and (III) are represented by:

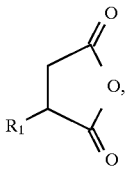

(I)

-continued

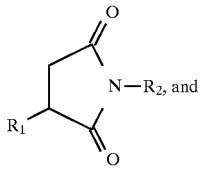

(II)

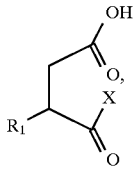

(III)

where: $R_1$ is a $C_6$ to $C_{30}$ isomerized alkenyl group represented by:

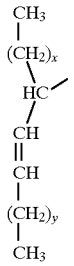

where x and y are integers whose sum is from 1 to 25, or its fully saturated analog, $R_2$ contains no less than 2 and no more than 100 carbon atoms and is an alkyl group, aryl group, or their heteroatom-containing derivatives, X is represented by

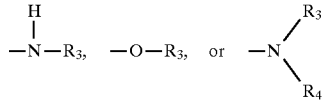

$R_3$ and $R_4$ are independently alkyl, aryl, or their heteroatom-containing derivatives; and (c) an oil-soluble phosphorus-containing compound.

* * * * *